US009557102B2

(12) United States Patent
Lee et al.

(10) Patent No.: US 9,557,102 B2
(45) Date of Patent: Jan. 31, 2017

(54) SYSTEMS AND METHODS FOR NATURAL GAS LIQUEFACTION CAPACITY AUGMENTATION

(71) Applicant: Bechtel Hydrocarbon Technology Solutions, Inc., Houston, TX (US)

(72) Inventors: Guang-Chung Lee, Houston, TX (US); Sudhir Golikeri, Richmond, TX (US)

(73) Assignee: Bechtel Hydrocarbon Technology Solutions, Inc., Houston, TX (US)

( * ) Notice: Subject to any disclaimer, the term of this patent is extended or adjusted under 35 U.S.C. 154(b) by 0 days.

(21) Appl. No.: 14/763,290

(22) PCT Filed: Jun. 19, 2014

(86) PCT No.: PCT/US2014/043183

§ 371 (c)(1),
(2) Date: Jul. 24, 2015

(87) PCT Pub. No.: WO2014/205216

PCT Pub. Date: Dec. 24, 2014

(65) Prior Publication Data

US 2016/0109178 A1 Apr. 21, 2016

Related U.S. Application Data

(60) Provisional application No. 61/837,162, filed on Jun. 19, 2013.

(51) Int. Cl.
*F25J 1/00* (2006.01)
*F25B 9/08* (2006.01)
(Continued)

(52) U.S. Cl.
CPC ..... *F25J 1/0022* (2013.01); *F25B 9/08* (2013.01); *F25J 1/006* (2013.01); *F25J 1/0047* (2013.01);
(Continued)

(58) Field of Classification Search
CPC ..... F25J 1/0022; F25J 1/0052; F25J 1/0212; F25J 1/0227; F25J 1/0242; F25J 1/0283; F25J 1/0047; F25J 1/0297; F25J 1/0291; F25B 9/08; F25B 2341/00; F25B 2341/0011; F25B 2341/0012; F25B 2341/0013; F25B 2241/0014; F25B 2339/046; F25B 2339/047
See application file for complete search history.

(56) References Cited

U.S. PATENT DOCUMENTS 3,680,327 A * 8/1972 Stein ..... F25B 1/08 417/167
4,829,763 A * 5/1989 Rao ..... F01K 21/047 60/39.53
(Continued)

OTHER PUBLICATIONS

Lee W. Young, Notice of Transmittal of The International Search Report and The Written Opinion of the International Searching Authority, International Application No. PCT/US14/43183, Dec. 16, 2014, 16 pages, International Searching Authority, Alexandria, Virginia.
(Continued)

*Primary Examiner* — Keith Raymond
(74) *Attorney, Agent, or Firm* — Crain, Caton & James

(57) ABSTRACT

Systems and methods for natural gas liquefaction capacity augmentation using supplemental cooling systems and methods to improve the efficiency of a liquefaction cycle for producing liquefied natural gas (LNG).

4 Claims, 4 Drawing Sheets

(51) Int. Cl.
*F25J 1/02* (2006.01)
*F25B 1/08* (2006.01)

(52) U.S. Cl.
CPC ..... *F25J 1/0052* (2013.01); *F25J 1/0212* (2013.01); *F25J 1/0227* (2013.01); *F25J 1/0242* (2013.01); *F25J 1/0283* (2013.01); *F25J 1/0291* (2013.01); *F25J 1/0297* (2013.01); *F25B 1/08* (2013.01); *F25B 2339/046* (2013.01); *F25B 2339/047* (2013.01); *F25B 2341/00* (2013.01); *F25B 2341/0011* (2013.01); *F25B 2341/0012* (2013.01); *F25B 2341/0013* (2013.01); *F25B 2341/0014* (2013.01); *F25J 2240/70* (2013.01); *F25J 2240/82* (2013.01); *F25J 2270/906* (2013.01)

(56) References Cited

U.S. PATENT DOCUMENTS

| | | | | |
|---|---|---|---|---|
| 5,406,786 | A * | 4/1995 | Scharpf | C01B 13/02 60/39.12 |
| 2010/0212329 | A1 * | 8/2010 | Bridgwood | F25J 1/0022 62/48.2 |
| 2010/0275645 | A1 | 11/2010 | Van De Rijt | |
| 2011/0088399 | A1 | 4/2011 | Briesch et al. | |

OTHER PUBLICATIONS

Frantz Jules, Notification of Transmittal of International Preliminary Report on Patentability, International Application No. PCT/US14/43183, May 28, 2015, 30 pages, International Preliminary Examining Authority, Alexandria, Virginia.

* cited by examiner

SYSTEMS AND METHODS FOR NATURAL GAS LIQUEFACTION CAPACITY AUGMENTATION

CROSS-REFERENCE TO RELATED APPLICATIONS

This Application claims priority from PCT Patent Application Serial No. PCT/US14/43183, filed on Jun. 19, 2014, which claims priority from U.S. Provisional Patent Application Ser. No. 61/837,162, filed on Jun. 19, 2013, which are incorporated herein by reference.

STATEMENT REGARDING FEDERALLY SPONSORED RESEARCH

Not applicable.

FIELD OF THE DISCLOSURE

The present disclosure generally relates to systems and methods for natural gas liquefaction capacity augmentation. More particularly, the present disclosure relates to natural gas liquefaction capacity augmentation using supplemental cooling systems and methods to improve the efficiency of a liquefaction cycle for producing liquefied natural gas (LNG).

BACKGROUND

Process feed gas in an LNG plant generally goes through a series of pre-treatment stages to remove acid gas, mercury and moisture and avoid freezing or corrosion problems in the cryogenic section. A generic single mixed refrigerant (SMR) liquefaction cycle may be used to cool and liquefy process feed gas such as, for example, natural gas. The process feed gas typically passes through a heat exchanger with the SMR for cooling the process feed gas that is used for producing LNG. The SMR is cooled using a primary cooling system comprising water at a temperature that is—around 25° C. The primary cooling system may include one or more heat exchangers for cooling the SMR with the cooling water before it passes through the heat exchanger with the process feed gas. The SMR liquefaction cycle may include one or more compressors for circulating the SMR through the one or more heat exchangers and a separator. The compressors are typically driven by a gas turbine engine that produces waste heat in the form of a hot combusted gas, A generic SMR liquefaction cycle requires about 40 MW to produce 1 million tons per annum (MTPA) of LNG. If the process feed gas was cooler, then the amount of LNG produced may be increased or the same amount of LNG may be produced with less energy consumption. In addition, the cooling water used in the primary cooling system and the waste heat from the gas turbine are not recycled or used in any supplemental manner to improve the efficiency of a liquefaction cycle for producing LNG.

SUMMARY OF THE DISCLOSURE

The present disclosure overcomes one or more deficiencies in the prior art by providing systems and methods for natural gas liquefaction capacity augmentation using supplemental cooling systems and methods to improve the efficiency of a liquefaction cycle for producing LNG.

In one embodiment, the present disclosure includes a supplemental cooling system for chilling a process feed gas, which comprises: i) a liquid chiller ejector system; ii) a steam input line in fluid communication with the liquid chiller injector system; iii) a chilled liquid line wherein each end of the chilled liquid line is in fluid communication with the liquid chiller ejector system; and (iv) a knock back condenser enclosing a portion of a process feed gas line and a portion of the chilled liquid line, wherein the process feed gas line and the chilled liquid line are positioned in sufficient proximity to each other in the heat exchanger to affect heat transfer between the process feed gas when it passes through the process feed gas line and a chilled liquid when it passes through the chilled liquid line.

In another embodiment, the present disclosure includes a supplemental cooling system for chilling a process feed gas, which comprises: i) a process vessel with a chilled liquid input line; ii) a steam ejector in fluid communication with the process vessel wherein the steam ejector is connected to a steam input line; and iii) a heat exchanger positioned within the process vessel, the heat exchanger enclosing a position of a process feed gas line, a portion of a refrigeration intercooler line and a portion of a refrigeration aftercooler line, wherein the process feed gas line, the refrigeration intercooler line and the refrigeration aftercooler line are positioned in sufficient proximity to each other within the heat exchanger to affect heat transfer between a chilled liquid when it surrounds the heat exchanger in the process vessel, a refrigeration intercooler as it passes through the refrigeration intercooler line, a refrigeration aftercooler as it passes through the refrigeration aftercooler line and the process feed gas as it passes through the process feed gas line.

Additional aspects, advantages and embodiments of the disclosure will become apparent to those skilled in the art from the following description of the various embodiments and related drawings.

BRIEF DESCRIPTION OF THE DRAWINGS

The present disclosure is described below with references to the accompanying drawings in which like elements are referenced with like reference numerals, and in which.

DETAILED DESCRIPTION OF THE PREFERRED EMBODIMENTS

The subject matter of the present disclosure is described with specificity, however, the description itself is not intended to limit the scope of the disclosure. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the present disclosure may be applied in the oil and gas industry, it is not limited thereto and may also be applied in other industries to achieve similar results.

The following description refers to FIGS. 1-6, which includes systems and methods for natural gas liquefaction capacity augmentation using supplemental cooling systems to improve the efficiency of a liquefaction cycle for producing LNG. In FIGS. 1-6, various embodiments of a supplemental cooling system are illustrated in different exemplary liquefaction cycles. The supplemental cooling system embodiments may be characterized as either a chilled water loop system illustrated in FIGS. 1-5 or a direct chilled water system illustrated in FIG. 6. Although chilled water is the primary or preferred fluid component in each supplemental cooling system, other fluids may be used instead. Each system may be easily extended to liquefaction cycles other than those illustrated and may use one or more conventional heat exchangers to affect heat transfer between a process feed gas and the supplemental cooling system. The pressures and temperatures described below are exemplary and only for purposes of illustration.

Figure 1:
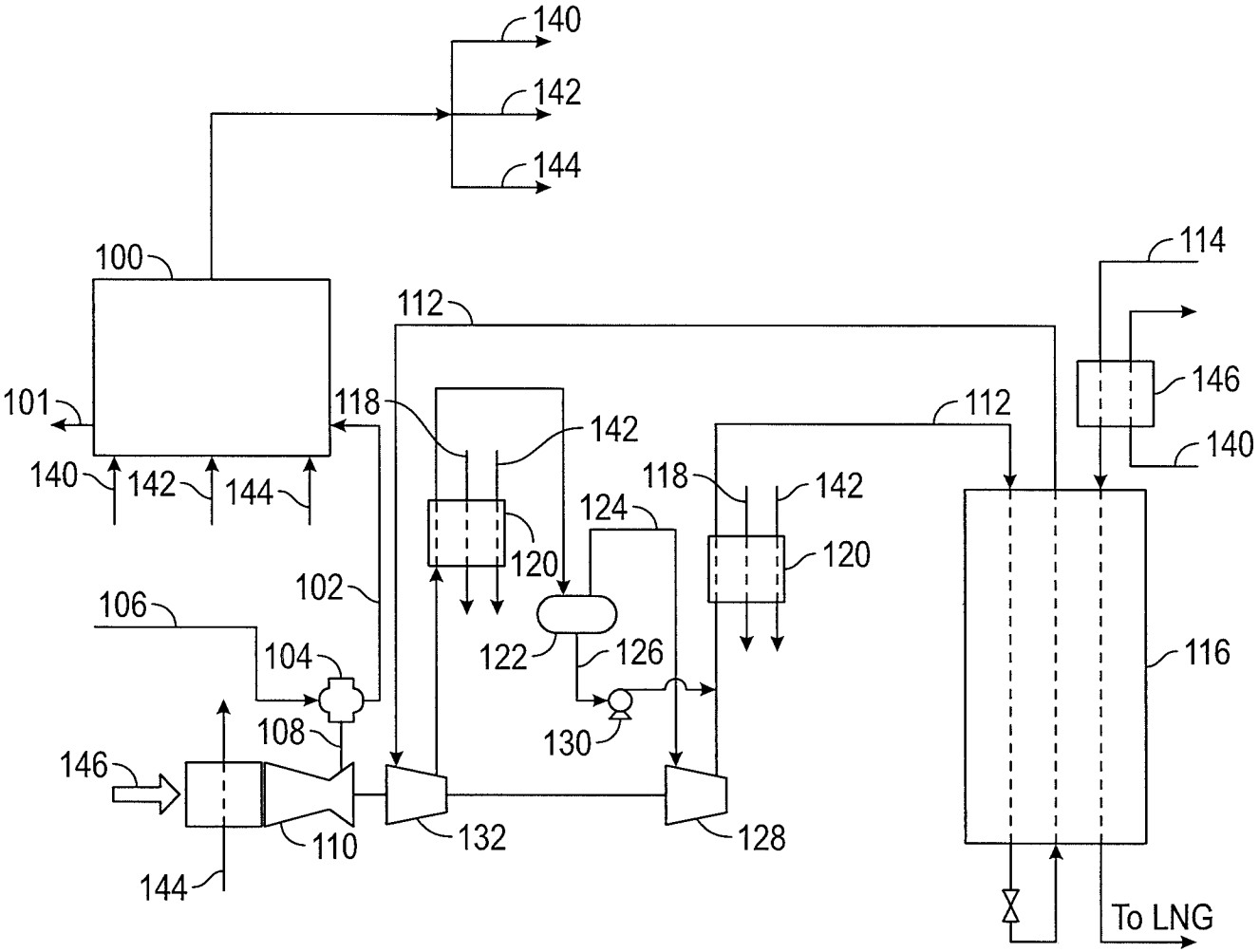
FIG. 1 is a schematic diagram illustrating one embodiment of a supplemental cooling system used in a liquefaction cycle according to the present disclosure.

Referring now to FIG. 1, a schematic diagram illustrates one embodiment of a supplemental cooling system 100 used in a generic SMR liquefaction cycle according to the present disclosure. The supplemental cooling system 100 uses steam 102 produced by one or more conventional heat recovery steam generators 104 to produce water chilled to a temperature of about 8° C. to about 0° C. A pressure for the steam 102 as low as 3 barg can be used to drive the supplemental cooling system 100, although it becomes incrementally more efficient at higher pressures. Each heat recovery steam generator 104 is driven by boiler feed water 106 and hot combusted gas 108 from a conventional gas turbine engine 110. A steam condensate 101 leaves the supplemental cooling system 100 and may be used to produce the boiler feed water 106.

The SMR liquefaction cycle includes the SMR 112, which is used to cool process feed gas 114 to a temperature of about −160° C. as each passes through a conventional primary heat exchanger 116. The SMR 112 is circulated in a closed loop at a temperature of about 12° C. The SMR 112 is cooled to 12° C. using a primary cooling system and the supplemental cooling system 100. The primary cooling system comprises water 118 at a temperature above about 25° C. The primary cooling system may include one or more conventional secondary heat exchangers 120 for cooling the SMR 112 with the water 118 before it passes through the primary heat exchanger 116 with the process feed gas 114. The SMR liquefaction cycle also includes a conventional separator 122 for separating the SMR 112 into a SMR gas 124 and SMR liquid 126. The SMR gas 124 leaves the separator 122 and enters a compressor 128. The SMR liquid 126 leaves the separator 122 and is merged with the SMR 112 leaving the compressor 128 because the compressor 128 will not accept the SMR liquid 126. Thus, the separator 122 is needed to separate the SMR liquid 126 from the SMR 112. A pump 130 may be used to merge the SMR liquid 126 with the SMR 112. Another compressor 132 may be used to raise the pressure enough to maintain circulation of the SMR 112. The compressors 128, 132 are driven by the gas turbine engine 110 that produces waste heat in the form of the hot combusted gas 108.

The supplemental cooling system 100 produces one or more chilled water streams at a temperature of about 8° C. to about 0° C. Here, there are three (3) chilled water streams 140, 142 and 143. Stream 140 is used to chill the process feed gas 114 to a temperature of about 12° C. as each passes through a conventional supplemental heat exchanger 146. In this manner, the process feed gas 114 is pre-cooled to a temperature of about 12° C. by the stream 140 using the supplemental heat exchanger 146 before it enters the primary heat exchanger 116 where it is further cooled and liquefied to a temperature of about −160° C. by the SMR 112 using the primary heat exchanger 116. Alternatively, stream 140 may be used to chill the process feed gas 114 as each passes through the primary heat exchanger 116. In other words, stream 140 may pass directly through the primary heat exchanger 116 thus, eliminating the need for the supplemental heat exchanger 146. Stream 142 is used to chill the SMR 112 as each passes through the secondary heat exchangers 120. Stream 142 is thus, split into two streams, one for each secondary heat exchanger. Alternatively, an additional chilled water stream may be produced by the supplemental cooling system 100 to chill the SMR 112 as each passes through one of the secondary heat exchangers 120. Stream 144 is used to chill inlet air 146 from about 30° C. to 40° C. (ambient) to about 12° C. as each passes through the gas turbine engine 110 using techniques and equipment well known in the art. Each stream 140, 142, and 144 is returned to the supplemental cooling system 100 at a temperature of about 25° C. to 32° C. where it is chilled back down to a temperature of about 8° C. to about 0° C. using steam 102 produced by one or more conventional heat recovery steam generators 104. Various designs and equipment are commercially available to use in the supplemental cooling system 100 to produce chilled water through steam driven ejectors. For example, a standard steam ejector, flash drum and condenser may be used in the supplemental cooling system 100 as described in reference to FIGS. 3-5.

Figure 2:
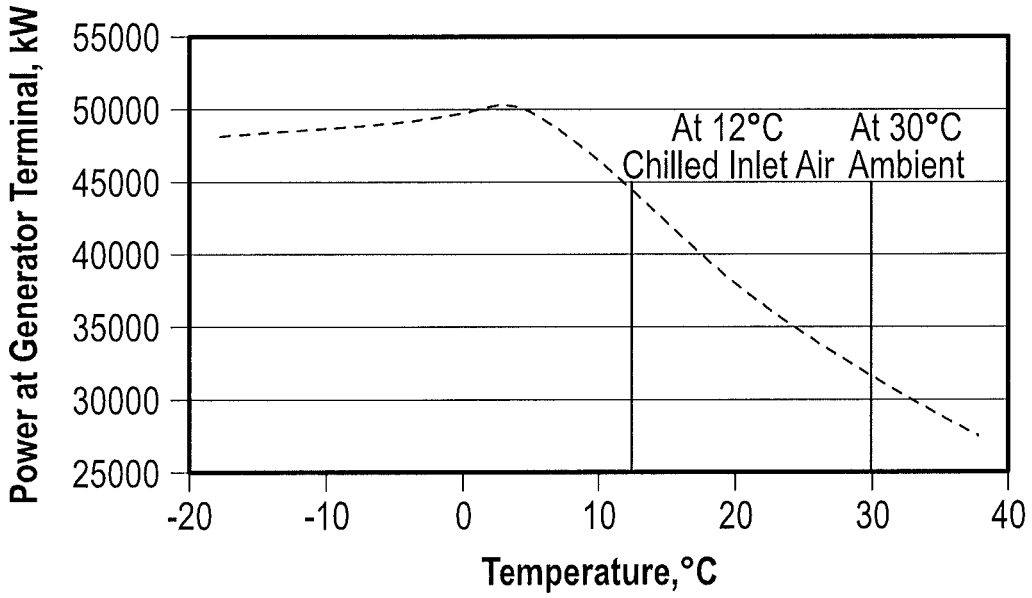
FIG. 2 is a graph illustrating the power output of a gas turbine engine used in the supplemental cooling system of FIG. 1 at various inlet air temperatures.

A generic SMR liquefaction cycle requires about 40 MW to produce 1 MTPA of LNG. With the supplemental cooling system 100, the power requirement for producing 1 MTPA LNG may be reduced to about 32 MW, which is a 20% power requirement reduction. Using the same gas turbine engine 110 and 40 MW power requirement thus, may be expected to produce 1.4 MTPA LNG, which is a 40% increase in LNG production. In FIG. 2, a graph illustrates the anticipated power output of a gas turbine engine (e.g. General Electric aero-derivative LM6000) used in the supplemental cooling system 100 of FIG. 1 at various inlet air temperatures. As can be seen by FIG. 2, lowering the inlet air temperature may increase the power output from about 32 MW at 30° C. (ambient) to about 45 MW at 12° C. (chilled inlet air).

Figure 3:
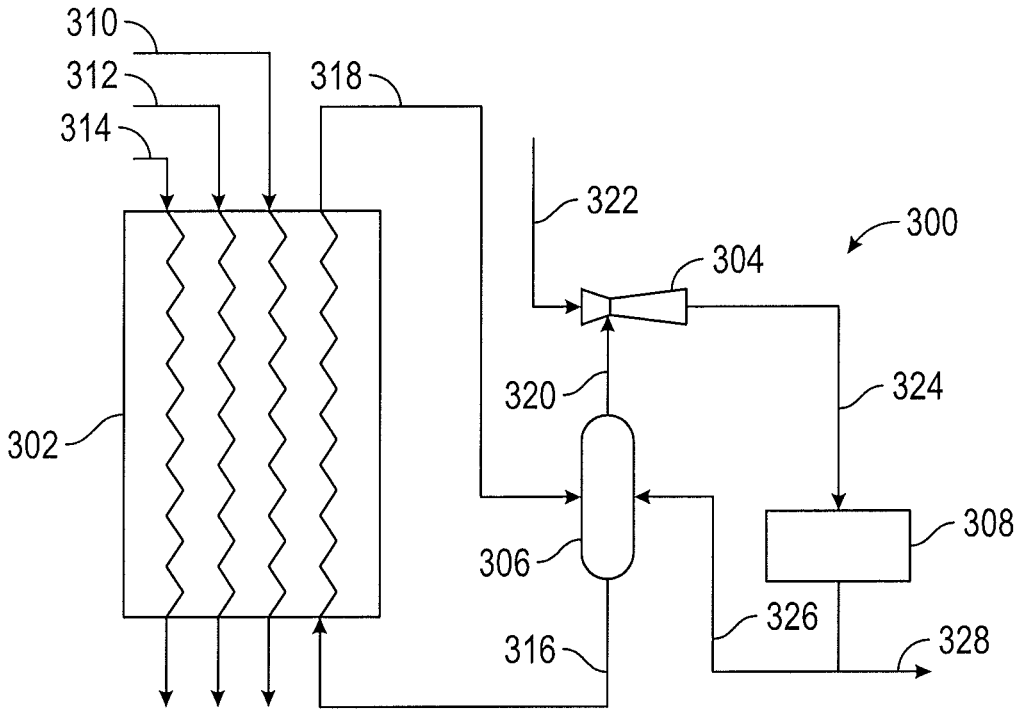
FIG. 3 is a schematic diagram illustrating another embodiment of a supplemental cooling system used in another liquefaction cycle according to the present disclosure.

Referring now to FIG. 3, a schematic diagram illustrates another embodiment of a supplemental cooling system 300 used in another liquefaction cycle according to the present disclosure. A primary cooling system includes a refrigeration aftercooler 310, a refrigeration intercooler 312 and a conventional multi-stream heat exchanger 302 (for compactness and high efficiency) that are used with the supplemental cooling system 300 to cool the process feed gas 314 to a temperature of about 12° C. as each passes through the multi-stream heat exchanger 302. Otherwise, the process feed gas 314 would only be cooled to about 30° C. to 32° C. if only the refrigeration aftercooler 310 and the refrigeration intercooler 312 were used. The multi-stream heat exchanger 302 is a plate-fin type heat exchanger, however, may be a wound-coil type heat exchanger. The supplemental cooling system 300 comprises a steam ejector 304, a flash drum 306 and a condenser 308. The flash drum 306 produces a chilled water stream 316 at a temperature of about 8° C. to about 0° C. The chilled water stream 316 is used with the refrigeration aftercooler 310 and the refrigeration intercooler 312 to chill the process feed gas 314 to a temperature of about 12° C. as each passes through the multi-stream heat exchanger 302. The chilled water stream 316 inside the multi-stream heat exchanger 302 absorbs heat from the process feed gas 314, the refrigeration aftercooler 310, and the refrigeration intercooler 312, and becomes partially vaporized before recirculating back to the flash drum 306 as a two-phase vapor and liquid stream 318. A resulting vapor stream 320 comprising water vapor inside the flash drum 306 is continuously removed by the steam ejector 304. The steam ejector 304 uses steam 322 from one or more conventional heat recovery steam generators (not shown) to discharge another vapor stream 324 from the steam ejector 304. The another vapor stream 324 is sent to the condenser 308 where it is totally condensed. A portion of the condensate 326 may be recirculated back to the flash drum 306 and another portion of the condensate 328 may be sent to one or more conventional heat recovery steam generators (not shown) for steam generation from gas turbine waste heat.

Figure 4:
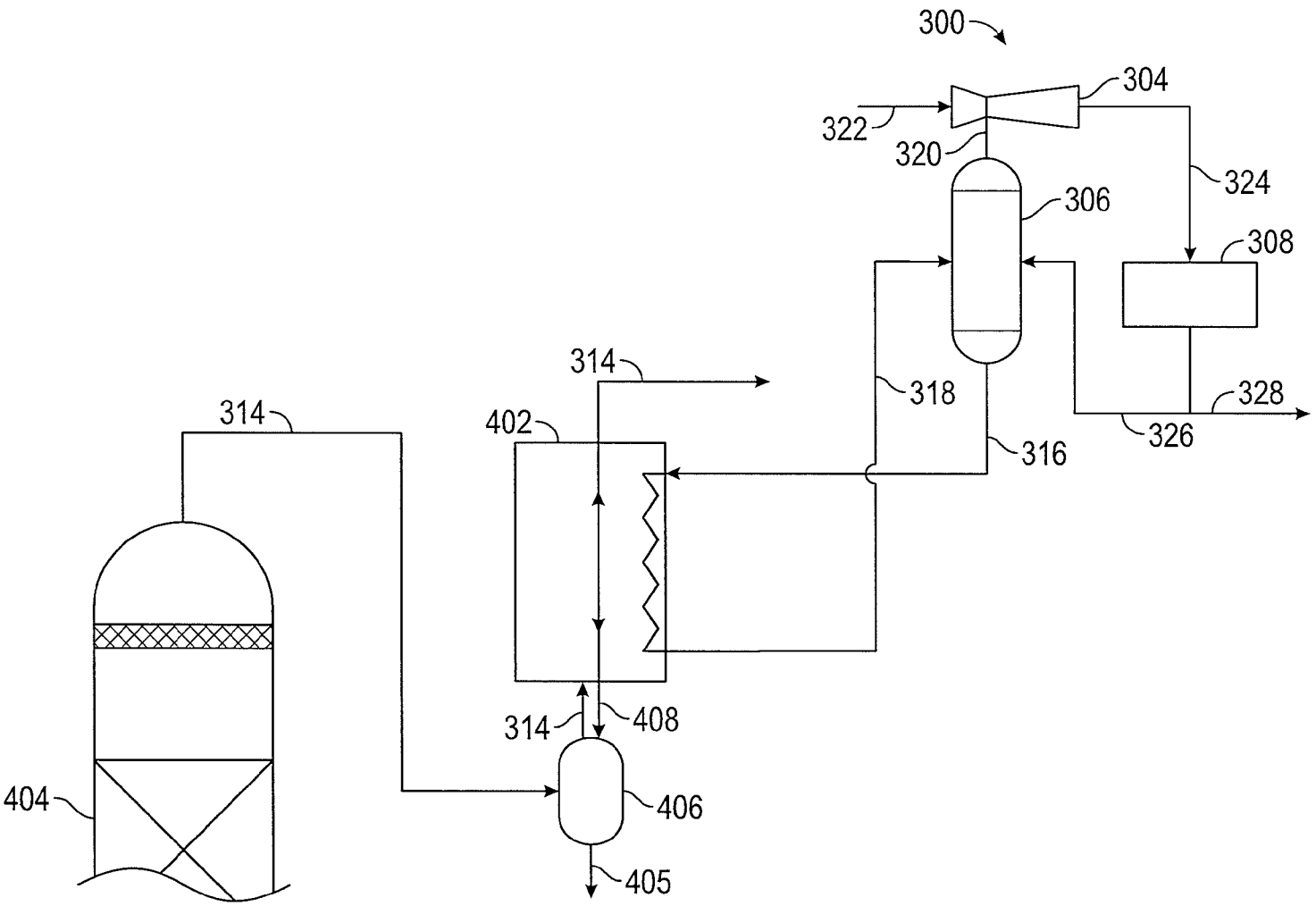
FIG. 4 is a schematic diagram illustrating the supplemental cooling system in FIG. 3 used in another liquefaction cycle according to the present disclosure.

Referring now to FIG. 4, a schematic diagram illustrates the supplemental cooling system 300 in FIG. 3 used in another liquefaction cycle according to the present disclosure. The supplemental cooling system 300 comprises a steam ejector 304, a flash drum 306 and a condenser 308. The flash drum 306 produces a chilled water stream 316 at a temperature of about 8° C. to about 0° C. The chilled water stream 316 is used to chill the process feed gas 314 to a temperature of about 15° C. as each passes through a knock back condenser 402, which may also be referred to as a reflux condenser or dephlegmator. The chilled water stream 316 inside the knock back condenser 402 absorbs heat from the process feed gas 314 and becomes partially vaporized after leaving the knock back condenser 402 before recirculating back to the flash drum 306 as a two-phase vapor and liquid stream 318 at about 32° C. A resulting vapor stream 320 comprising water vapor inside the flash drum 306 is continuously removed by the steam ejector 304. The steam ejector 304 uses steam 322 from one or more conventional heat recovery steam generators (not shown) to discharge another vapor stream 324 from the steam ejector 304. The another vapor stream 324 is sent to the condenser 308 where it is totally condensed. A portion of the condensate 326 may be recirculated back to the flash drum 306 and another portion of the condensate 328 may be sent to one or more conventional heat recovery steam generators (not shown) for steam generation from gas turbine waste heat. The process feed gas 314 leaves an acid gas absorber 404 at about 45° C. and is sent to a separator 406. The process feed gas 314 leaves the separator 406 and is sent to the knock-back condenser 402. An amine solvent 405 also leaves the separator 406. In the knock back condenser 402, a water-rich liquid phase stream 408 is formed and returns back to the separator 406. The process feed gas 314 leaving the knock-back condenser 402 has a significantly lower moisture content and is nearly free of amine. It is also possible to use a conventional shell-and-tube type heat exchanger or other forms of heat exchangers, such as plate-fin heat exchanger, to replace the knock-back condenser with slightly lower separation efficiency.

As demonstrated by the placement of the supplemental cooling system 300 illustrated in FIG. 4, the process feed gas 314 is pre-cooled downstream from the acid gas absorber 404 before entering a dehydration unit. The process feed gas 314 may also be pre-cooled downstream from a dehydration or mercury removal unit (not shown) before entering a liquefaction unit (not shown) using the same supplemental cooling system 300. One of the advantages of pre-cooling a process feed gas before entering a dehydration unit is that, as the process feed gas temperature is reduced, the moisture content is also reduced thus, unloading the dehydration unit and minimizing amine loss from the acid gas absorber. This can result in reduced capital cost and operating cost.

Figure 5:
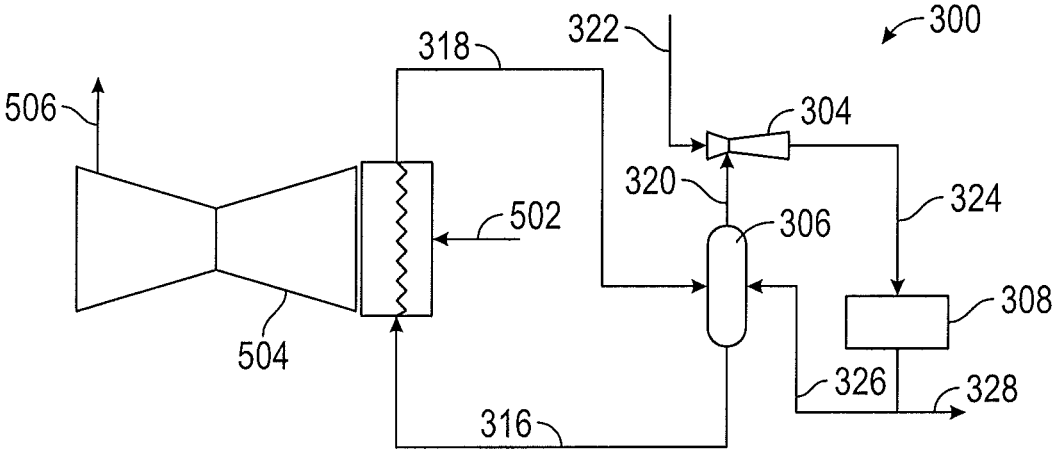
FIG. 5 is a schematic diagram illustrating the supplemental cooling system in FIG. 3 used in another liquefaction cycle according to the present disclosure.

Referring now to FIG. 5, a schematic diagram illustrates the supplemental cooling system 300 in FIG. 3 used in another liquefaction cycle according to the present disclosure. The supplemental cooling system 300 comprises a steam ejector 304, a flash drum 306 and a condenser 308. The flash drum 306 produces a chilled water stream 316 at a temperature of about 8° C. to about 0° C. The chilled water stream 316 is used to chill inlet air 502 at an ambient temperature flowing through a gas turbine engine 504 to a temperature of about 12° C. as each passes through the gas turbine engine 504. The inlet air 502 acts as the primary cooling system for the gas turbine engine 504. The chilled water stream 316 inside the gas turbine engine 504 absorbs heat from the inlet air 502 and becomes partially vaporized before recirculating back to the flash drum 306 as a two-phase vapor and liquid stream 318. A resulting vapor stream 320 comprising water vapor inside the flash drum 306 is continuously removed by the steam ejector 304. The steam ejector 304 uses steam 322 from one or more conventional heat recovery steam generators (not shown) to discharge another vapor stream 324 from the steam ejector 304. The another vapor stream 324 is sent to the condenser 308 where it is totally condensed. A portion of the condensate 326 may be recirculated back to the flash drum 306 and another portion of the condensate 328 may be sent to one or more conventional heat recovery steam generators (not shown) for steam generation using the waste heat (exhaust air) 506 from the gas turbine engine 504. Depending on the temperature of the chilled water stream 316, a multi-stage steam ejector design may be employed.

Figure 6:
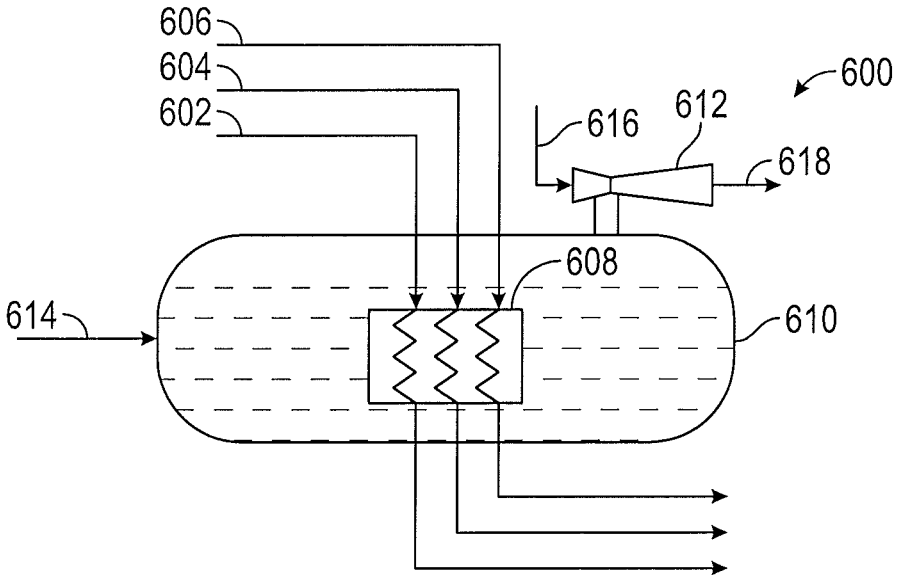
FIG. 6 is a schematic diagram illustrating another embodiment of a supplemental cooling system used in another liquefaction cycle according to the present disclosure.

Referring now to FIG. 6, a schematic diagram illustrates another embodiment of a supplemental cooling system 600 used in another liquefaction cycle according to the present disclosure. The primary cooling system includes a refrigeration aftercooler 602, a refrigeration intercooler 604 and a multi-stream heat exchanger 608 that are used with the supplemental cooling system 600 to cool the process feed gas 606 to a temperature of about 12° C. as each passes through the multi-stream heat exchanger 608. Otherwise, the process feed gas 606 would only be cooled to about 30° C. to 32° C. if only the refrigeration aftercooler 602 and the refrigeration intercooler 604 were used. The multi-stream heat exchanger 608 is a plate-fin type heat exchanger, however, may be a wound-coil type heat exchanger. The supplemental cooling system 600 comprises a process vessel 610 and a steam ejector 612. A chilled water stream 614 is sent to the process vessel 610 at a temperature of about 8° C. to about 0° C. The chilled water in the process vessel 610 is used with the refrigeration aftercooler 602 and the refrigeration intercooler 604 to chill the process feed gas 606 in the multi-stream heat exchanger 608 to a temperature of about 12° C. The chilled water in the process vessel 610 absorbs heat from the multi-stream heat exchanger 608 and other heat sources (e.g. the refrigeration aftercooler 602, refrigeration intercooler 604, process feed gas 606), which is continuously vaporized at a constant pressure. Thus, there is preferably a continuous supply of the chilled water stream 614 to maintain chilled water in the process vessel 610. The vaporization of the chilled water is at a reduced pressure such that the water temperature is maintained. The generated vapor is continuously removed by the steam ejector 612 to maintain the reduced pressure in the process vessel 610. In this way, the heat exchange between the chilled water and the heat sources takes advantage of the constant temperature of latent heat during water vaporization. Therefore, the overall heat exchanger surface requirement will be smaller, thus saving capital cost. The steam ejector 612 uses steam 616 from one or more conventional heat recovery steam generators (not shown) to discharge a vapor stream 618 from the steam ejector 304. This embodiment may also be referred to as using "core-in-kettle" technology for compactness and high heat exchanger efficiency. Depending on the temperature of the chilled water stream 614, a multi-stage steam ejector design may be employed. The process vessel 610 may be positioned horizontally or vertically.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A supplemental cooling system for chilling a process feed gas, which comprises:

a liquid chiller ejector system;

a steam input line in fluid communication with the liquid chiller ejector system;

a chilled liquid line wherein each end of the chilled liquid line is in fluid communication with the liquid chiller ejector system; and a heat exchanger enclosing a portion of a process feed gas line and a portion of the chilled liquid line, wherein the process feed gas line and the chilled liquid line are positioned in sufficient proximity to each other in the heat exchanger to affect heat transfer between the process feed gas when the process feed gas passes through the process feed gas line and a chilled liquid when the chilled liquid passes through the chilled liquid line; wherein the heat exchanger encloses a portion of a refrigeration intercooler line and a portion of a refrigeration aftercooler line, the refrigeration intercooler line and the refrigeration aftercooler line each positioned in sufficient proximity to the process feed gas line and the chilled liquid line in the heat exchanger to affect heat transfer between the process feed gas when the process feed gas passes through the process feed gas line, the chilled liquid when the chilled liquid passes through the chilled liquid line, a refrigeration intercooler when the refrigeration intercooler passes through the refrigeration intercooler line and a refrigeration aftercooler when the refrigeration aftercooler passes through the refrigeration aftercooler line.

2. The system of claim 1, wherein the liquid chiller ejector system comprises a steam ejector, a flash drum and a condenser.

3. The system of claim 2, wherein the steam ejector, the flash drum and the condenser are in fluid communication with each other, the steam ejector is connected to the steam input line and the flash drum is connected to each end of the chilled liquid line.

4. A supplemental cooling system for chilling a process feed gas, which comprises:

a process vessel with a chilled liquid input line;

a steam ejector in fluid communication with the process vessel wherein the steam ejector is connected to a steam input line: and a heat exchanger positioned within the process vessel, the heat exchanger enclosing a portion of a process feed gas line, a portion of a refrigeration intercooler line and a portion of a refrigeration aftercooler line, wherein the process feed gas line, the refrigeration intercooler line and the refrigeration aftercooler line are positioned in sufficient proximity to each other within the heat exchanger to affect heat transfer between a chilled liquid when the chilled liquid surrounds the heat exchanger in the process vessel, a refrigeration intercooler as the refrigeration intercooler passes through the refrigeration intercooler line, a refrigeration aftercooler as the refrigeration aftercooler passes through the refrigeration aftercooler line and the process feed gas as the process feed gas passes through the process feed gas line.

* * * * *